US006109392A

United States Patent [19]

Merrick

[11] Patent Number: 6,109,392

[45] Date of Patent: Aug. 29, 2000

[54] SPLIT PLATFORM LADDER STAND

[76] Inventor: Harry G. Merrick, N. 32112 Pend O'Reille Rd., Chattaroy, Wash. 99003

[21] Appl. No.: 09/393,222

[22] Filed: Sep. 9, 1999

[51] Int. Cl.[7] ..... E06C 7/16

[52] U.S. Cl. ..... 182/121

[58] Field of Search ..... 182/120–122, 182/117

[56] References Cited

U.S. PATENT DOCUMENTS

| | | | |
|---|---|---|---|
| 743,899 | 11/1903 | Lynch . | |
| 1,084,034 | 1/1914 | Roberts . | |
| 1,285,817 | 11/1918 | Sklar . | |
| 1,487,243 | 3/1924 | Jackson . | |
| 2,080,015 | 5/1937 | Sneddon . | |
| 2,282,133 | 5/1942 | Horton . | |
| 2,415,289 | 2/1947 | Jury . | |
| 2,934,162 | 4/1960 | Williams | 182/120 |
| 3,503,468 | 3/1970 | Taylor | 182/121 |
| 3,797,607 | 3/1974 | Gargasz | 182/82 |
| 3,899,045 | 8/1975 | Geisel et al. | 182/121 |
| 4,618,030 | 10/1986 | Campbell | 182/121 |
| 4,646,878 | 3/1987 | Moyer | 182/121 |
| 4,687,075 | 8/1987 | Skaggs | 182/121 |
| 4,800,988 | 1/1989 | Dunmore | 182/103 |
| 4,911,265 | 3/1990 | Skaggs | 182/121 |
| 4,953,661 | 9/1990 | Hilton et al. | 182/120 |
| 5,005,668 | 4/1991 | Nowlan | 182/121 |
| 5,044,466 | 9/1991 | Jacobsmeyer, Jr. | 182/121 |
| 5,056,620 | 10/1991 | Zumwalt et al. | 182/120 |
| 5,060,755 | 10/1991 | Bourdages et al. | 182/121 |
| 5,072,808 | 12/1991 | Spalt et al. | 182/103 |
| 5,337,857 | 8/1994 | Spalt et al. | 182/122 |
| 5,388,665 | 2/1995 | Newman | 182/122 |
| 5,465,809 | 11/1995 | Panicci | 182/121 |
| 5,507,363 | 4/1996 | Tredup | 182/122 |

FOREIGN PATENT DOCUMENTS

| | | | |
|---|---|---|---|
| 132835 | 5/1929 | Switzerland | 182/121 |
| 1179970 | 2/1970 | United Kingdom | 182/121 |
| 2161529 | 1/1986 | United Kingdom | 182/121 |

*Primary Examiner*—Alvin Chin-Shue

*Attorney, Agent, or Firm*—Wells, St. John, Roberts, Gregory & Matkin, P.S.

[57] ABSTRACT

A split platform ladder stand is described for releasable attachment between selected adjacent upper and lower treads on a conventional ladder. The stand includes a first platform having a first user support surface and a bottom lower tread engagement surface. A stabilizer extends upwardly from the first platform to a stabilizer yoke having an upper tread engagement surface. A second platform has a second user support surface mounted for selective adjustment in relation to the first platform. The second platform is movable between an operative position wherein the second user support surface is substantially coplanar with the first user support surface, and an inoperative position wherein the second user support surface is positioned angularly toward the stabilizer.

23 Claims, 9 Drawing Sheets

R
R
36
35
30
32
34
34
24
25
40
39
20
12
18
14
22
16
10
40
39

SPLIT PLATFORM LADDER STAND

TECHNICAL FIELD

The present invention relates to ladder mounted user support platforms and more particularly to a split platform ladder stand.

BACKGROUND OF THE INVENTION

Many different forms of ladder accessories have been developed over the years to overcome the long felt need for a platform that will fit on a conventional ladder and that will comfortably support the weight of a user.

Ladder treads or "rungs" are most often narrow and do not provide a good wide surface area for a user's feet. The tread is most often spanned by the arches of the user's feet. The user's weight is thus borne chiefly by arched parts of the feet that are not normally required to directly carry weight. The result is quickly developed fatigue and soreness that can lead to accidents. Thus, in attempts to add more tread surface support area, various platforms have been developed for releasable mounting to ladders. Some mount to the ladder rails independently of the treads, others mount to one or more treads.

The typical ladder mounted platform includes a solid, singular platform that spans the distance between ladder rails. Some platforms are hinged to a frame to enable pivotal movement of the platforms about axes that are parallel to the ladder rungs; others are fixed to the ladder rails.

Some platforms include stabilizers that extend between one tread and the next higher tread to secure the platform in position. And some of the stabilizers are adjustable for ladders having different tread spacing, while others are foldable to facilitate insertion and removal of the platforms into the areas between adjacent treads. Adjustments are provided to enable leveling of platforms according to the rail leaning angle. Still further, various devices have been developed to position of platforms so the user's feet will be received inward of the treads, outward of the treads, or straddling the treads.

Of all the prior known accessory platforms, none appear to offer a substantial degree of safety and ease of use. One of the primary problems is the platform structure. The typical platform spans the distance between rails. This means that both of the user's feet must be off the platform before it can be removed from the ladder or shifted to an inoperative position so the user can descend. Also, fixed platforms that project outwardly from the treads present a serious safety hazard to a user ascending the ladder. To get to a position above the platform, the user must step over or around the platform.

The present invention provides a solution to the safety and ease of use problem by providing a split platform. One section of the platform can be pivoted between: (A) an operative position substantially coplanar with a remaining platform section (which allows the user to stand normally on the ladder); and (B) an inoperative position that allows normal access to the adjacent ladder tread simply by lifting the hinged platform section. The hinged platform section also eases secure attachment and quick removal of the platform to a variety of ladders.

The above advantages and objectives of the present invention will become further evident from the attached drawings and following descriptions.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
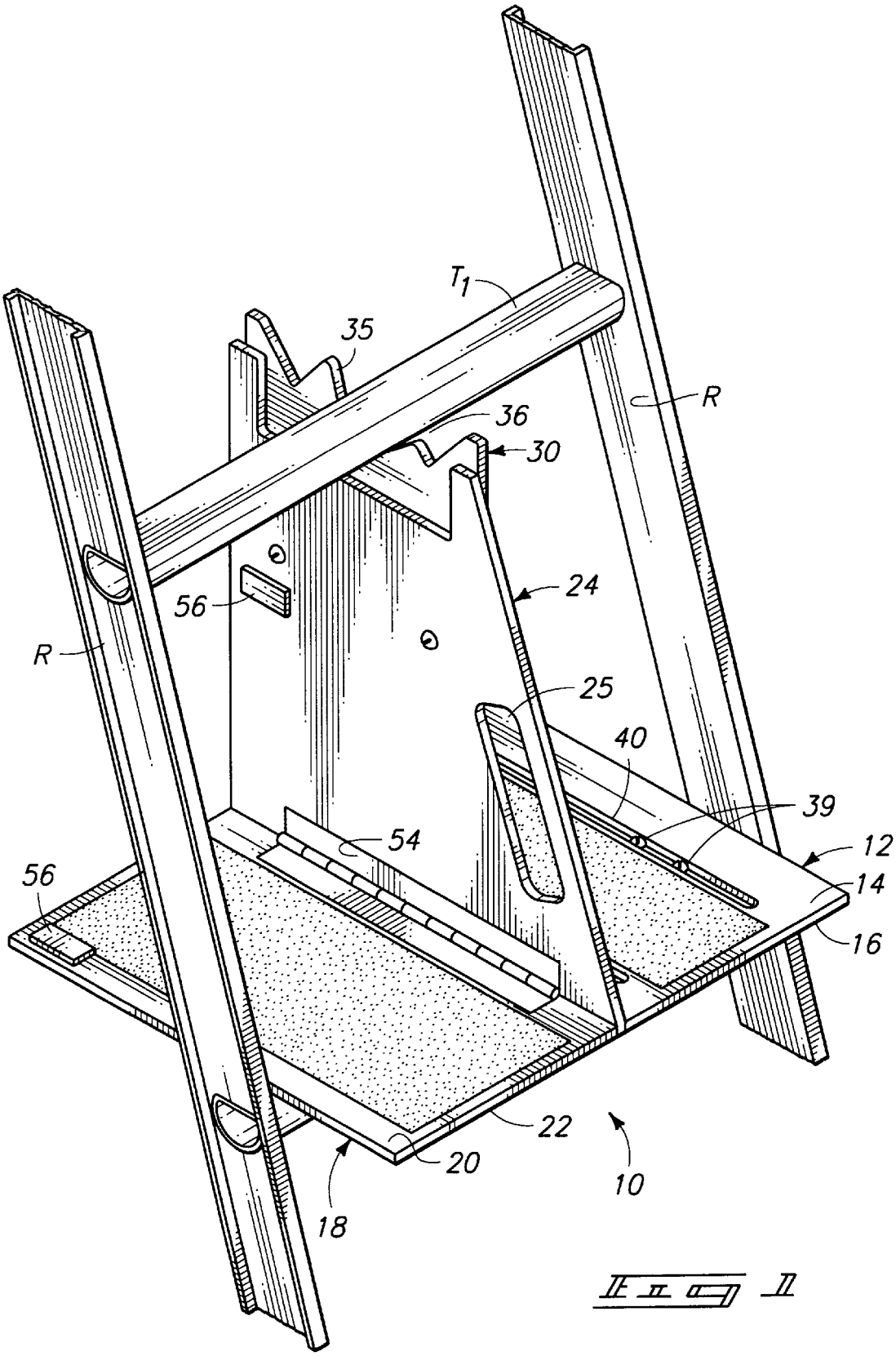
FIG. 1 is a perspective view of a first preferred form of the invention, mounted to a fixed tread ladder.

This disclosure of the invention is submitted in furtherance of the constitutional purposes of the U.S. Patent Laws "to promote the progress of science and useful arts" (Article 1, Section 8).

Preferred embodiments of the present ladder stand are generally designated in the drawings by the reference character 10. Preferred stands 10 are configured for releasable attachment to conventional ladders. The term "conventional ladder," as used herein is intended to mean a ladder having opposed upright rails R spaced apart by substantially uniformly spaced treads T (also frequently called "rungs").

Figure 5:
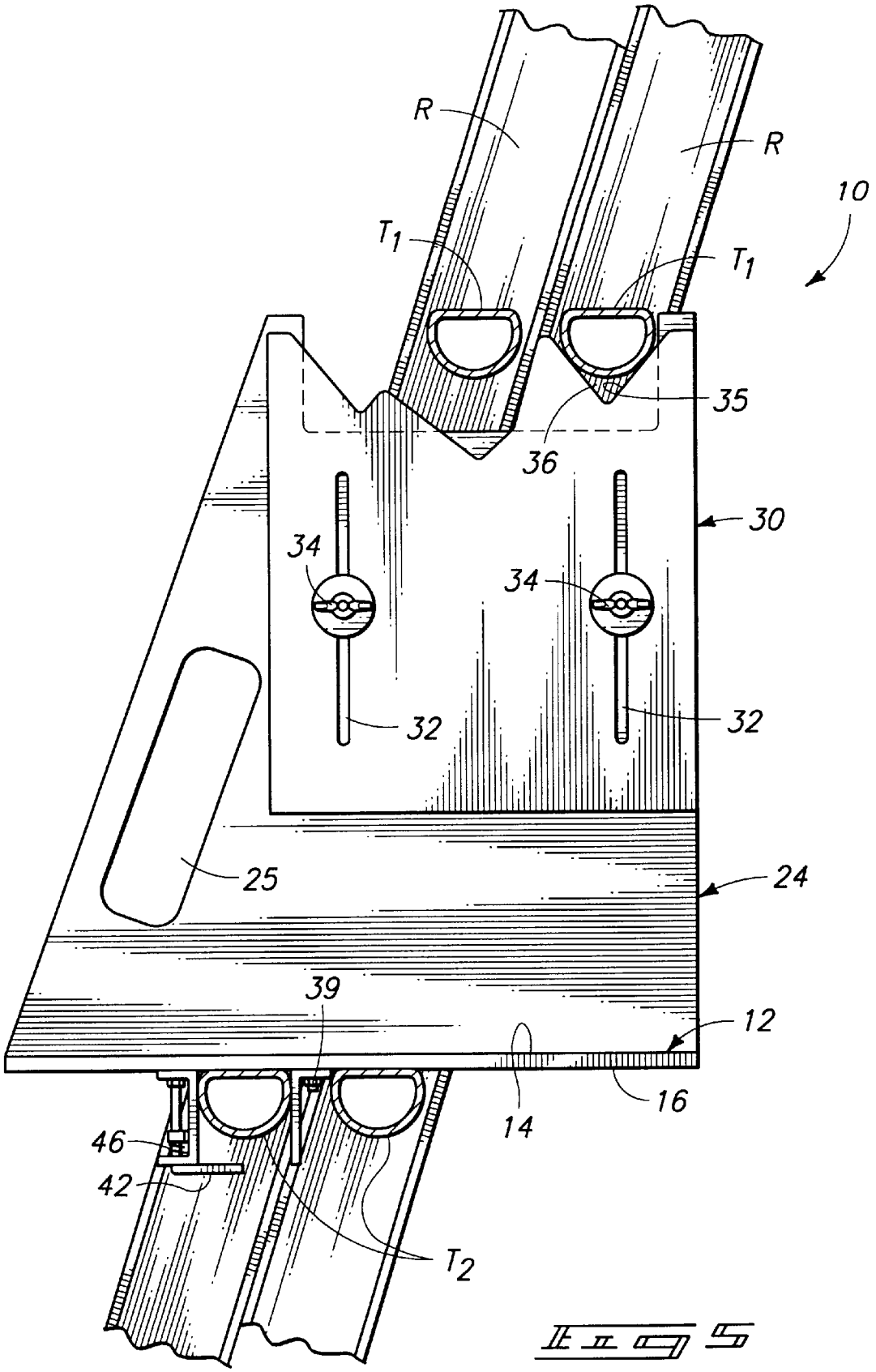
FIG. 5 is a view similar to FIG. 4 only showing the preferred stand mounted to the double tread sections of an extension ladder.
Figure 6:
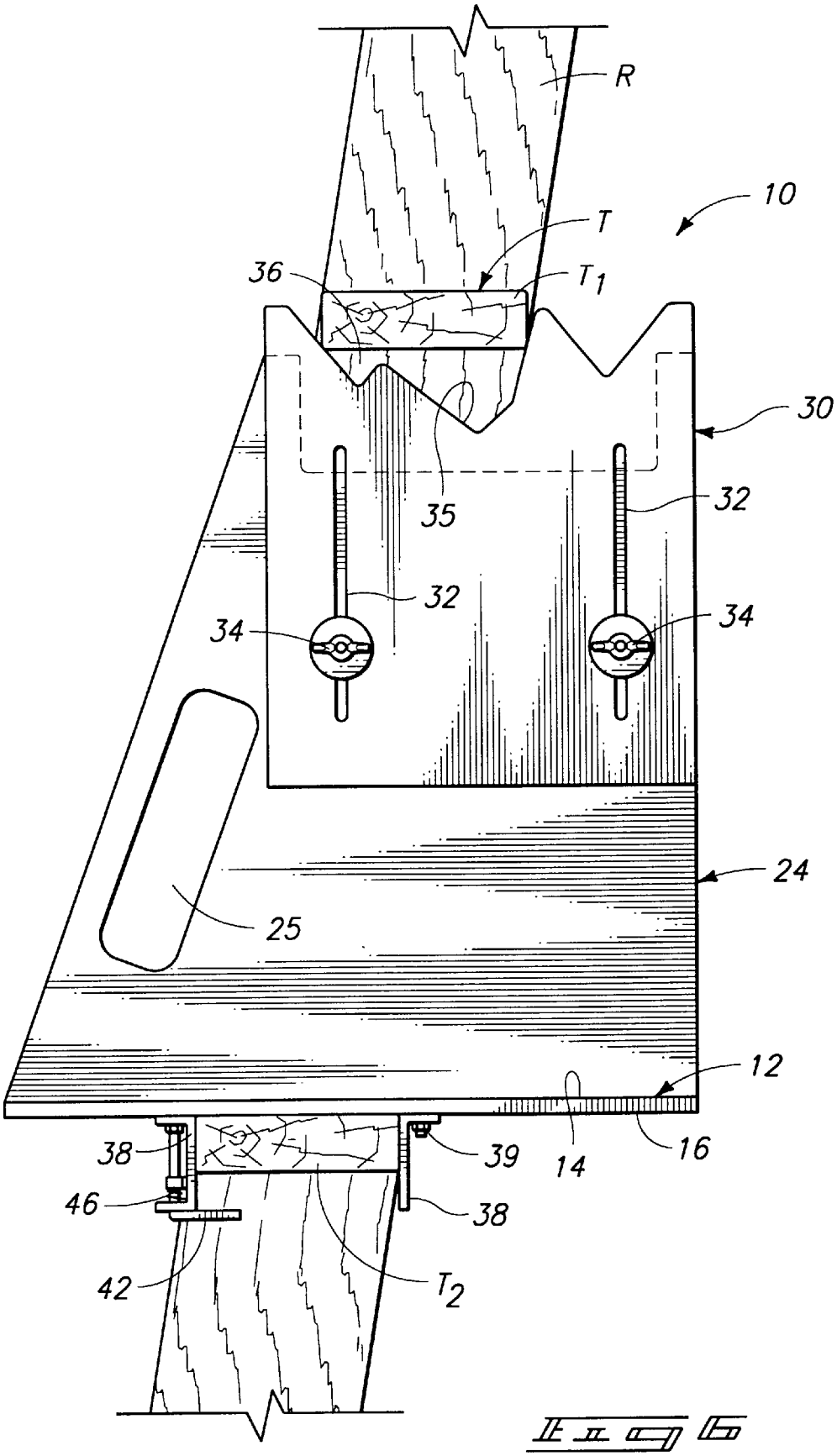
FIG. 6 is a view similar to FIG. 4 only showing the stand mounted to a wooden step ladder.

In FIGS. 1–4 a preferred form of the present split platform ladder stand 10 is shown mounted to a fixed tread ladder. In FIG. 5 the stand 10 is shown mounted to a wooden tread step ladder where the treads are substantially rectangular in cross-section as shown. FIG. 6 shows a stand mounted to a metal tread or composite step ladder. These illustrations indicate an adaptability the present stand has for mounting to various forms of conventional ladders. Not shown are ladders with round or dowel type treads that may also accept the present stand 10. Other conventional ladder configurations may also be used with the present stand.

Forms of the present stand 10 are configured to be releasably attached between selected adjacent upper and lower treads on a conventional ladder. For ease of understanding, the terms "adjacent upper and lower treads" should be taken to mean any two adjacent treads on a ladder. Thus an upper tread, labeled T1, is any tread along the ladder that is immediately above another, or lower tread T2 in succession along longitudinal ladder rails R.

Of general interest, the distance between the treads T1 and T2 is typically constant for all treads in a given ladder. Tread spacing for ladders manufactured in the United States is usually between 8 and 12 inches for conventional ladders and is suggested by safety agencies in the US to be no more than approximately 12 inches. Spacing between the rails R may be more variable. In fact, in many free standing step ladder forms and some fixed tread ladders, the rails R converge upwardly.

Figure 2:
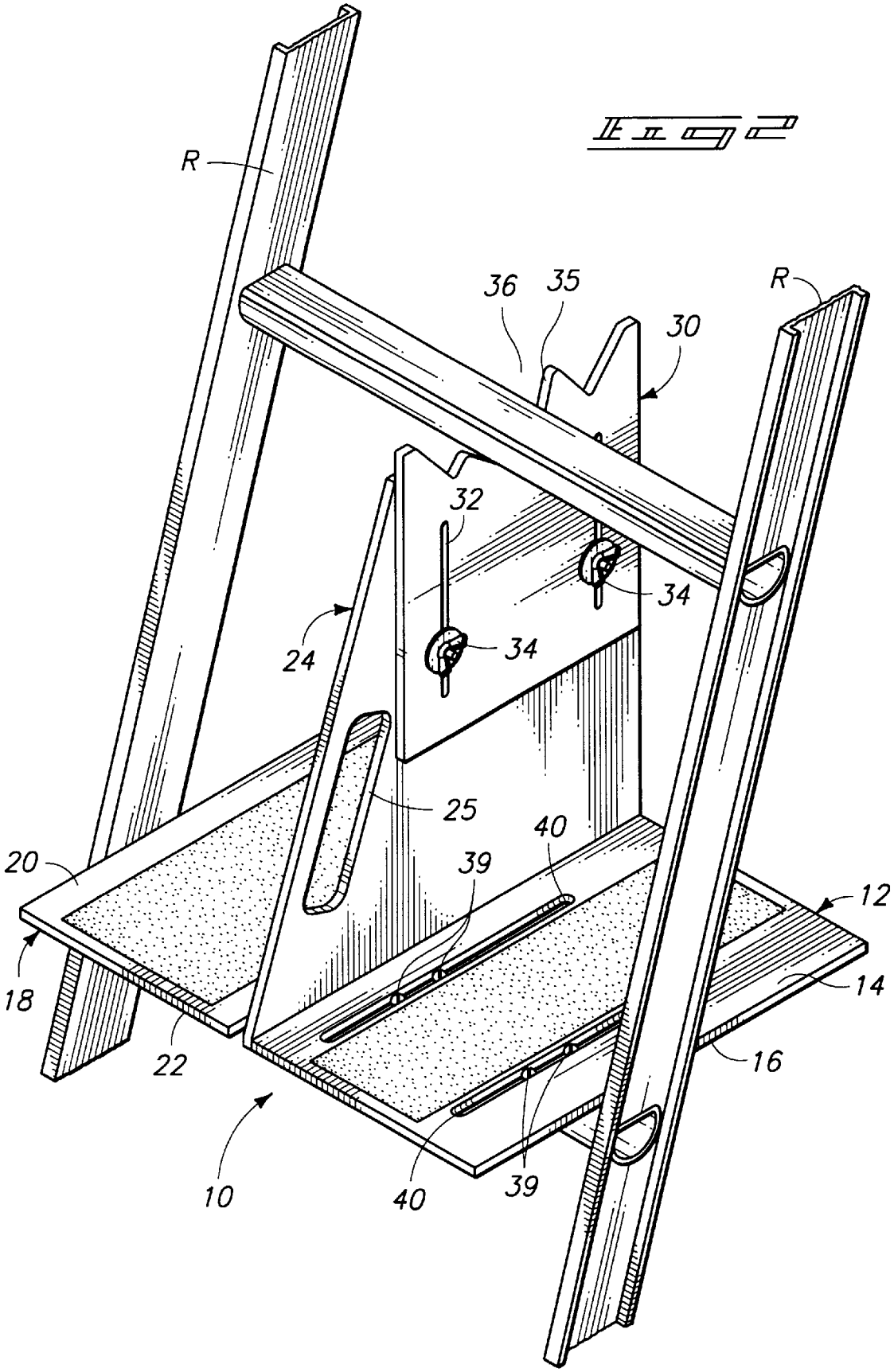
FIG. 2 is a perspective view similar to FIG. 1 taken from a different viewpoint.
Figure 3:
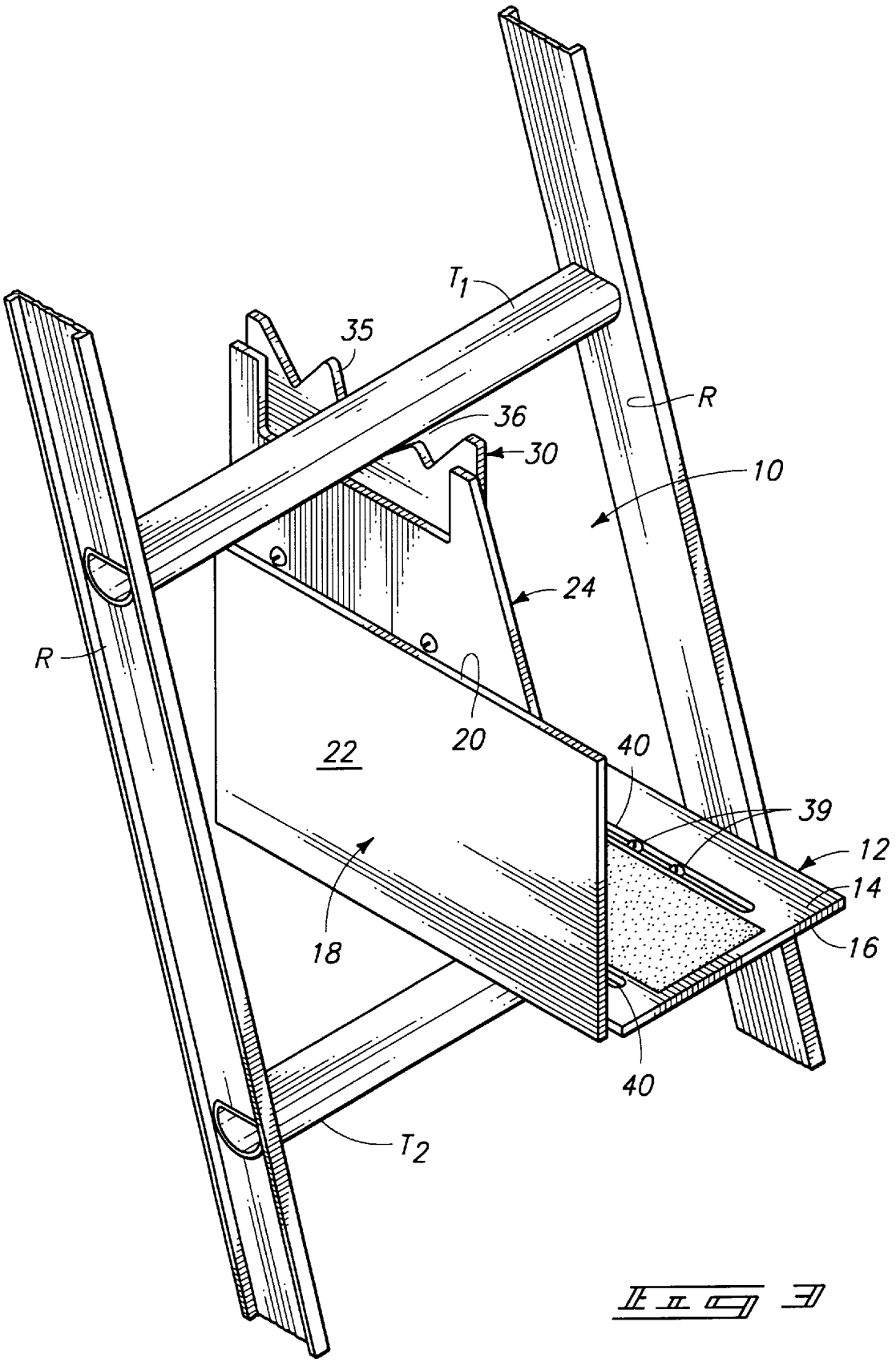
FIG. 3 is a perspective view taken from the same viewpoint as FIG. 1 only showing a second platform section in an inoperative position.

Looking now to the split platform stand in greater detail, reference is drawn to FIGS. 1–3. There, a first platform 12 is shown including a first user support surface 14 and a lower tread engagement surface 16. The first platform is preferably formed of a rigid material such as plate aluminum or plywood, and the preferred support surface 14 is flat and provided with a conventional traction covering or coating.

A second platform 18 having a second user support surface 20 is mounted in preferred forms for selective adjustment in relation to the first platform 12. The second platform is preferably similar in construction to the first platform. A lower surface 22 of second platform 18 is configured to rest upon the same tread as the tread engagement surface 16 of first platform 12. Thus, when both platforms are in the operative position on a ladder, as shown by FIGS. 1 and 2, the first and second support surfaces are substantially coplanar, and the lower surfaces 16, 22 are resting on the lower tread T2.

A stabilizer 24 is mounted in preferred forms of the present stand to the first platform 12. The illustrated stabilizer 24 extends upwardly from the first platform 12, and may be formed of the same rigid material. A hand-hold opening 25 may be provided in stabilizer 24 to facilitate carrying, mounting and dismounting of the stand 10.

A preferred form of the stabilizer 24 is affixed to or integral with the first platforms 12 and is situated at an approximate right angle to the first user support surface 14. In the example illustrated, the stabilizer 24 is situated along an inside end of the first platform. The stabilizer is thus advantageously situated approximately mid-way between the ladder rails R when the stand 10 is mounted to a ladder.

An upward end of the preferred stabilizer mounts a stabilizer yoke 30 having an upper tread engagement surface 35 (to be described in greater detail later on). It is advantageous that the stabilizer yoke 30 be adjustable to vary the distance between the upper tread engagement surface 35 and the lower tread engagement surface 16 in order to match the spacing between adjacent treads on various ladders.

Adjustment slots 32 and wing nut assemblies 34 are provided in the preferred stabilizer example illustrated in FIG. 2, to facilitate the described adjustment. The slots 32 are preferably slightly oversized with respect to the wing nut assemblies to allow angular as well as elevational adjustment of the stabilizer yoke 30. Thus the stand can be adjusted to fit ladders with different tread spacing, and, further the angular position of the platforms 12, 18 through use of the oversize adjustment slots 32 and wing nut assemblies 34.

It should be noted that the slots 32 and wing nut assemblies 34 could be interchanged without departing from the scope of the invention. Specifically one or both slots 32 could be formed in the stabilizer 24 and corresponding wing nut assemblies 34 could be supplied on the stabilizer yoke 30. In either configuration, the adjustment capabilities would be similar.

The upper tread engagement surface 35 briefly described above is provided on the stabilizer yoke 30. The surface 35 may be formed by a notch 36 in the yoke 30 that is configured to receive and secure various ladder tread configurations. Examples of different ladder forms are illustrated in the drawings, with corresponding parts of the notch 36 being adjusted into contact therewith to hold the stand secure on the associated ladder.

The lower tread engaging surface 16 faces opposite the upper tread engagement surface 35 and is spaced therefrom by adjustment of the yoke 30 to match the spacing between successive treads on conventional ladders.

Figures 4, 8:
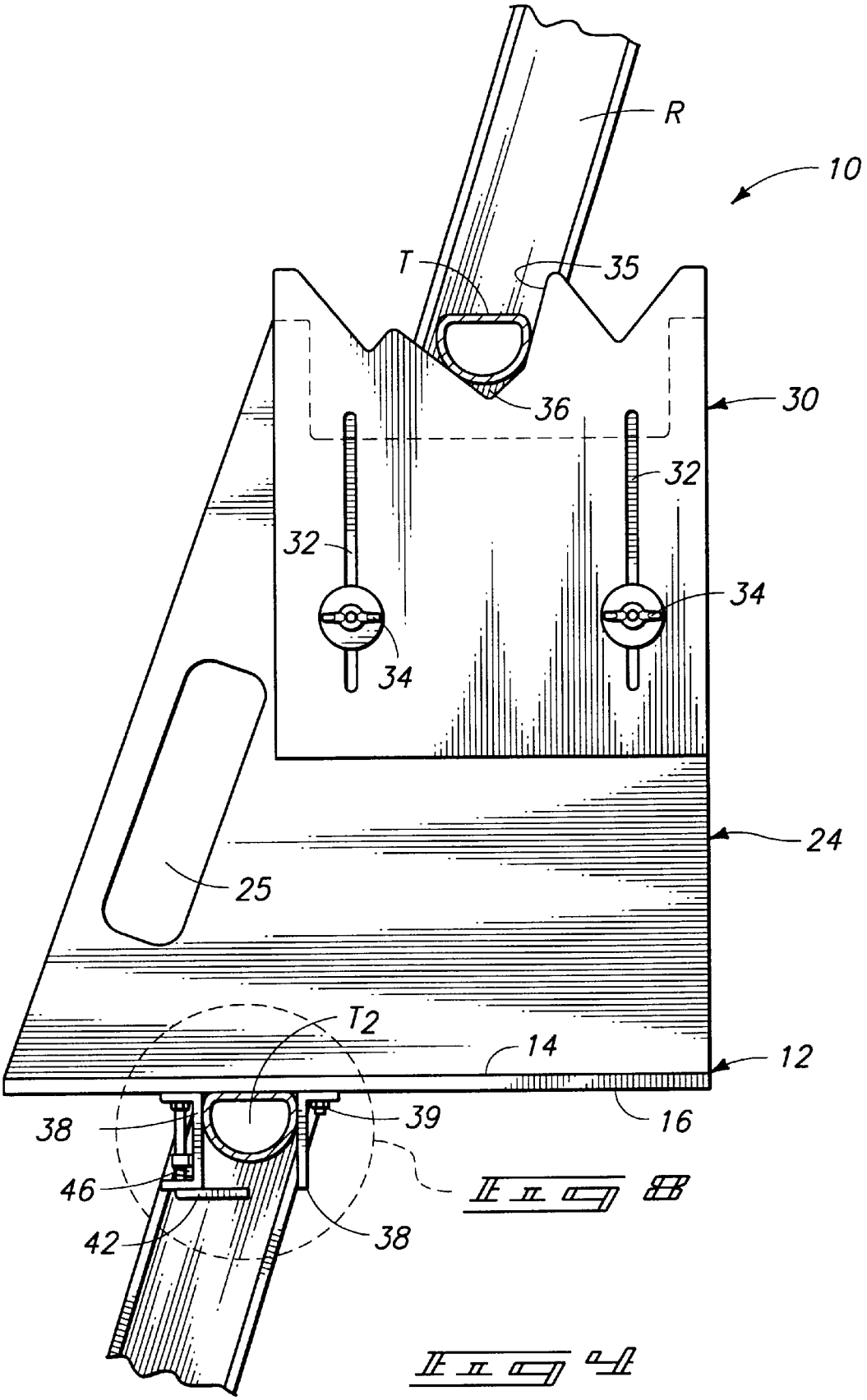
FIG. 4 is a sectional side view of a present stand and fixed tread ladder.
FIG. 8 is an enlarged fragmentary view of the area encircled and identified by FIG. 8 in FIG. 4.
Figure 7:
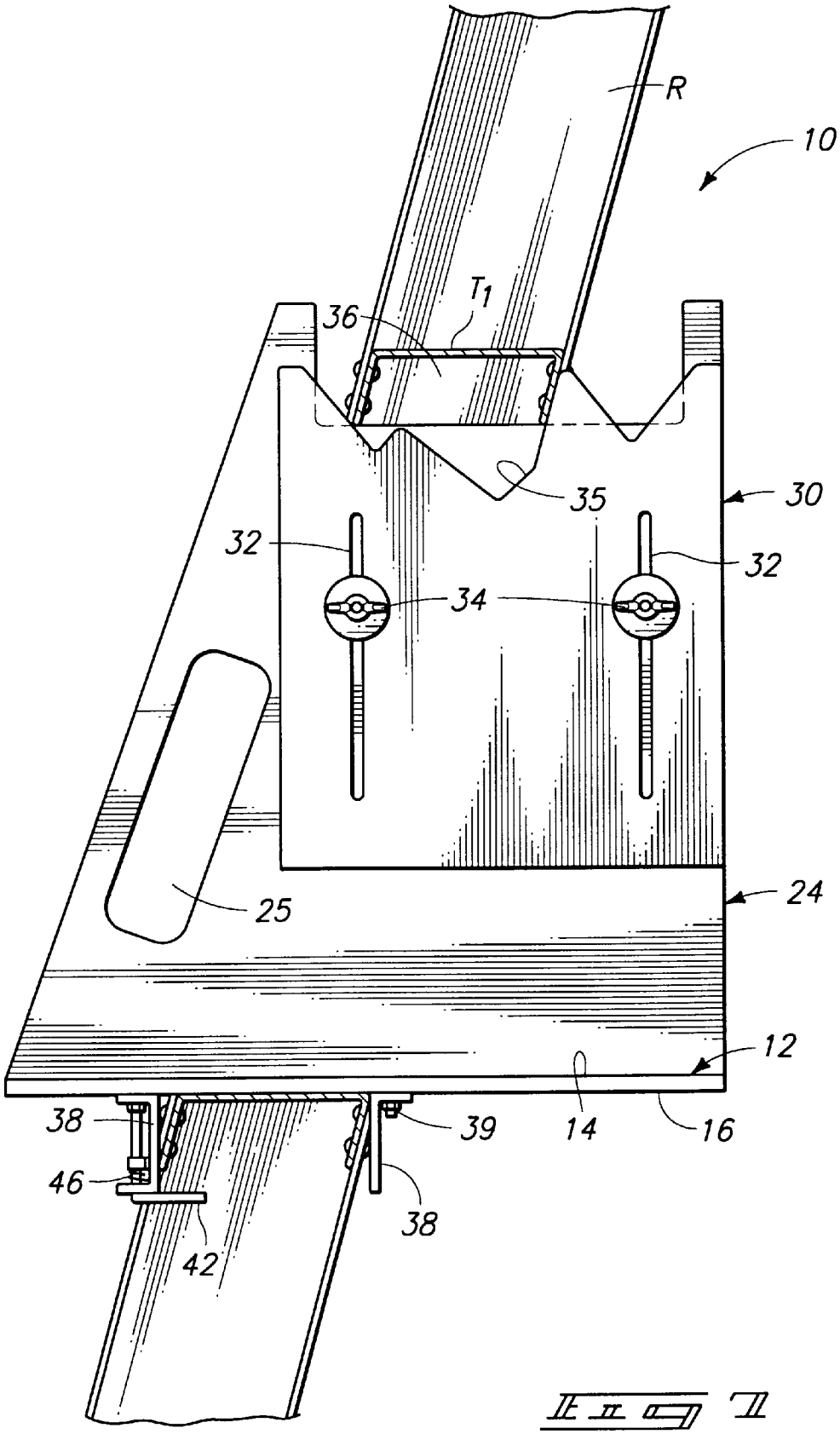
FIG. 7 is a view similar to FIG. 4 only showing the present stand mounted to a composite step ladder.
Figure 8:
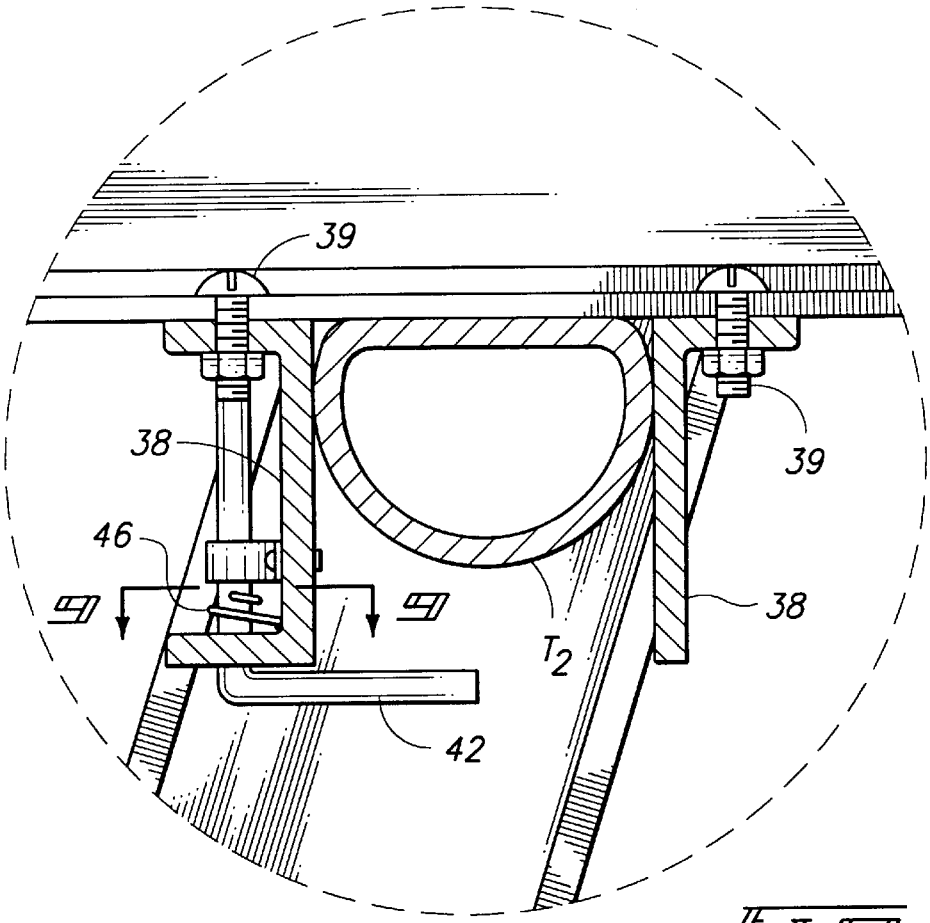

Lower tread engaging cleats 38 are preferred for adjustable mounting to the first platform and are configured to receive and stabilize the first platform on a ladder tread substantially as shown in FIG. 8. The lower tread engaging cleats 38 are adjustable toward and away from one another by provision of adjustment screws 39 and slots 40 formed in the first platform. The screws 39 may be loosened and the cleats 38 may be slid across the lower tread engaging surface 16 to accommodate ladder treads of differing configurations. FIG. 8 shows an example where the cleats are drawn close up against a fixed tread. Double treads (FIG. 5) may be similarly engaged by simple adjustments. FIGS. 6 and 7 show adjustment of the cleats 38 for reception of wider step ladder treads.

Figure 9:
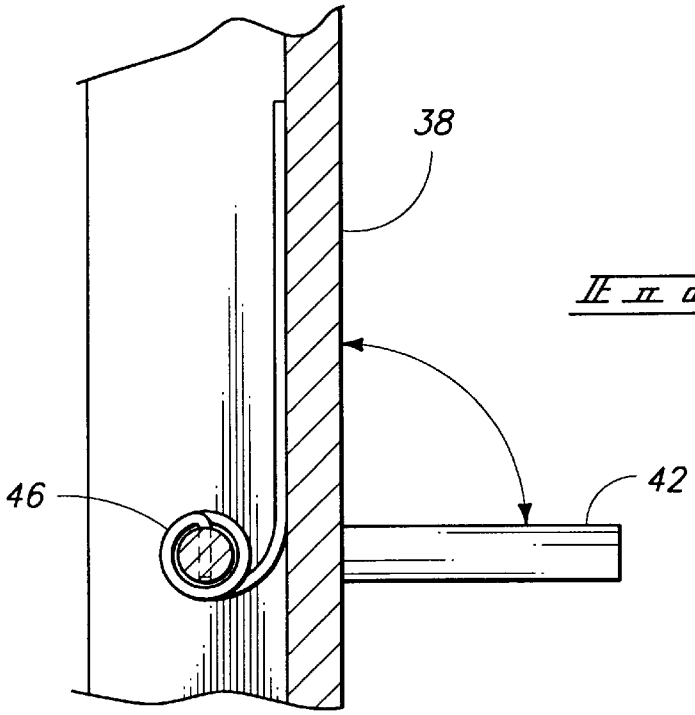
FIG. 9 is a fragmented plan view of the mechanism shown in FIG. 8.

As a preferred safety measure, a tread latch 42 may be provided to prevent the stand from being lifted unintentionally from a ladder tread. An exemplary latch is shown in several of the drawings and particularly in FIGS. 8 and 9. The exemplary latch is a simple pivoted "L" shaped bar that is normally biased to the illustrated operative position by a spring 46. The user may easily shift the latch 42 to the side, clear of an adjacent ladder tread to allow for intentional elevational movement of the stand, as when the stand is mounted to or removed from a ladder.

It is important to note that the first and second platforms 12, 18 will pivot relative to one another on the axis of a hinge 54 between:

(A) an operative position wherein the user support surfaces 14 and 20 are substantially coplanar (which allows the user to stand normally on the ladder); and (B) an inoperative position that allows normal access to the adjacent ladder tread and that facilitates mounting and removal of the stand to a ladder.

Most preferably, the second platform section 18 is hinged to the first platform section 12 and bottom edge of the stabilizer 24. The hinge axis is most preferably parallel to or coplanar with the plane of the first user support surface 14, thereby providing a relationship of the two platform sections that facilitates attachment and removal of the platform to a variety of ladders.

The orientation and location of the hinge axis is preferred to be substantially as shown, so the second platform section 18 will pivot to an inoperative position that is substantially parallel with the stabilizer. A magnet catch, a snap latch or other appropriate temporary fastener 56 (FIG. 1) may be provided to releasably hold the second platform 18 section in the inoperative position.

Operation of the present invention is easily accomplished following a brief and simple set-up procedure.

Figure 10:
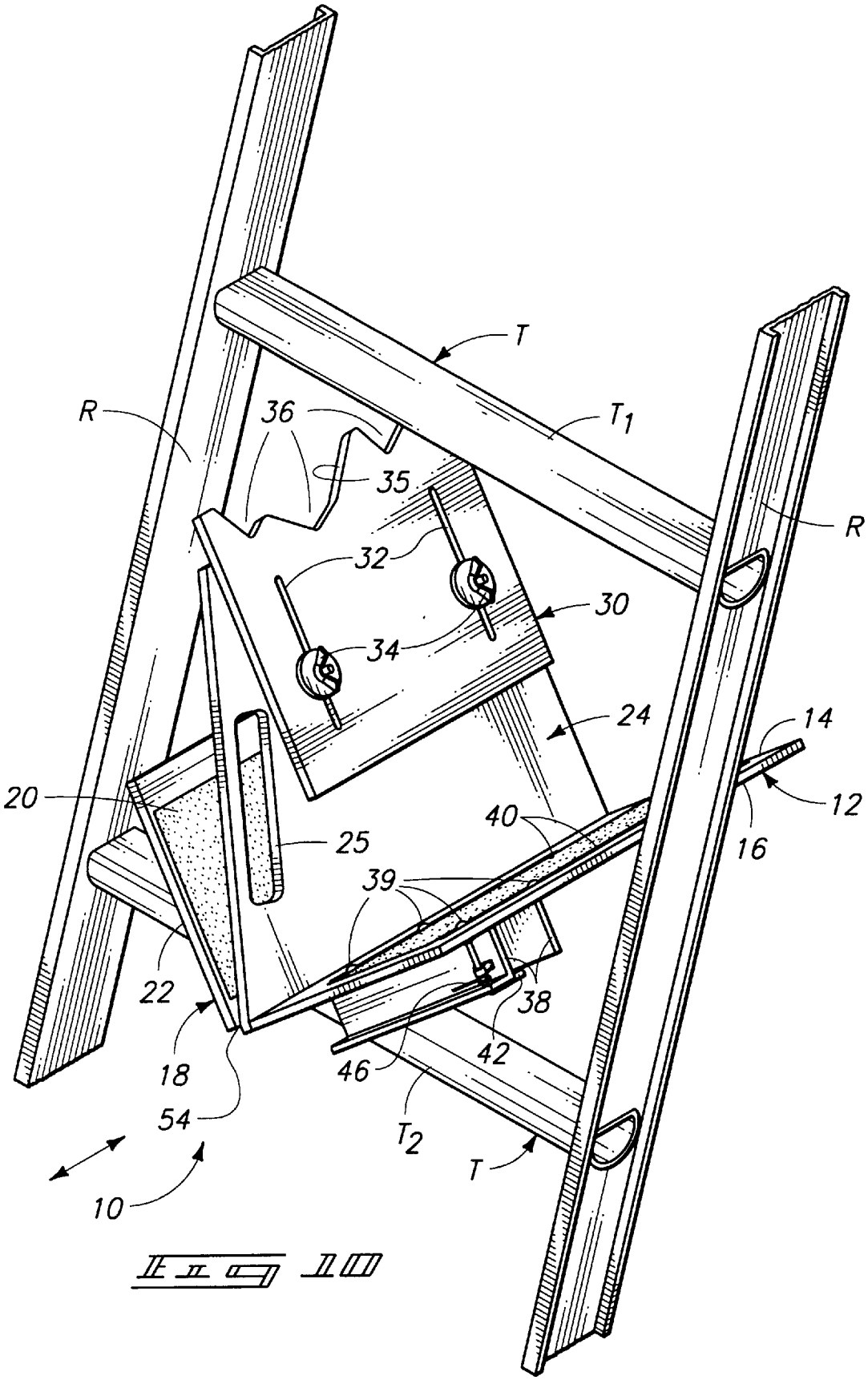
FIG. 10 is a perspective view showing the angular position of the stand during mounting and dismounting to a ladder.

Once the user has selected a ladder to which the present stand is to be mounted, mounting of the platform can be accomplished firstly by assuring that the second platform 18 is shifted to the inoperative position shown in FIGS. 3 and 10. This allows the stand to be angularly positioned as indicated in FIG. 10 for insertion between two successive rungs along the ladder. Once the stand is inserted, the first platform is moved down to a horizontal position where the engaged lower tread T2 of the ladder is positioned between the tread engaging cleats 38. The stabilizer 24 is automatically shifted to a vertical position, with the stabilizer yoke 30 immediately below the upper tread T1.

Now the stabilizer yoke 30 may be adjusted by loosening the wing nuts 34 and sliding the stabilizer yoke 30 upwardly, angularly, or both, to engage the upper tread engagement surface 35 with the upper tread T1. Note is taken regarding the angularly orientation of the first platform user support surface 14 at this point. If the surface 14 is not level, the over size adjustment slots 32 will permit angular positioning of the stabilizer yoke to substantially level the first platform support surface 14.

Now the lower tread engaging cleats 38 may be adjusted to sandwich the lower tread T2. This is done by sliding the cleats into position along either side of the lower tread. The tread latch 42 (being normally biased to an operative position) will slide under the tread T2.

Once the cleats are in position, the adjusting screws 39 may be tightened. This completes adjustment of the device to adapt the present stand to this particular ladder. The stand can now be mounted to and dismounted from the same ladder with speed and ease, since no further adjustments are needed.

To shift the stand to the completely ready position, the user simply pivots the second platform 18 downwardly to the operative position where the second user support surface 20 is substantially coplanar with the first user support surface 14. However, the user may wish to leave the second platform in the inoperative position until he or she is in position on the ladder. Thus the user may ascend the adder in a normal manner, climbing until the left foot is on the lower tread T2. The right foot can then be elevated simply by stepping up to and placing the foot on the first platform user support surface 14. Now the user may simply lift the left foot and use the toe to shift the second platform to its operative position. It can be understood that the user has attained his position without being required to climb around the stand. The access to the stand is very similar to normal climbing.

When the user wishes to descend, he or she may simply shift weight to the right foot, then use the left toe to lift the second platform 18 to the inoperative position, providing normal access to the next successive rung below. The user then steps down with the left foot to the next successive tread and follows with the right foot.

If the user wishes to change the position of the stand along the ladder, the second platform is simply pivoted upwardly to the inoperative position. The magnetic catch 56 will hold the second platform section in the inoperative position while the user grabs the stabilizer 24 and shifts the tread latch 42 to a position along one side of the engaged tread. Now the entire stand may be shifted angularly to the position indicated in FIG. 10. This disengages the upper tread engagement surface 35 and lower tread engaging cleats 38 from contact with the respective treads T1 and T2, and allows the stand to be moved laterally from between the treads. The user may now shift the stand to another position along the ladder. Reinsertion and mounting of the stand is now easily accomplished because no further adjustments need to be made of the yoke or tread engaging cleats. The user simply holds the stand at the angle shown in FIG. 10, inserts it between the selected adjacent treads, then shifts the tread latch 42 to the inoperative position before tipping the stand back to the operative position where the first platform is horizontal and the stabilizer is vertical.

It is pointed out that adjustments of the present platform can be made by the user to adjust the angle of the user support surfaces to a level position with respect to a tilt angle of the ladder. Also, the user has some discretion in positioning the stand so the platforms are substantially centered over the lower tread T2. This adjustment may be made by shifting the tread engaging cleats 38 appropriately, and by similarly adjusting the stabilizer yoke.

In compliance with the statute, the invention has been described in language more or less specific as to structural and methodical features. It is to be understood, however, that the invention is not limited to the specific features shown and described, since the means herein disclosed comprise preferred forms of putting the invention into effect. For example, the operational description above relates to the example stand 10 shown in the drawings. However, it is well within the scope of my invention to alter certain elements. For example, the stabilizer and tread engaging cleats could be mounted to the second platform, thereby making the stand "right footed"; so the user would be using his or her right foot to lift and lower the first platform instead of the left foot as described above. Other alterations, substitutions and changes may also be made without departing from the scope of my invention. The invention is, therefore, claimed in any of its forms or modifications within the proper scope of the appended claims appropriately interpreted in accordance with the doctrine of equivalents.

What is claimed is:

1. A split platform ladder stand for releasable attachment between selected adjacent upper and lower treads on a ladder, comprising a first platform including a first user support surface and a lower tread engagement surface;

a stabilizer fixedly mounted to the first platform and extending upwardly therefrom and forming an L-shape therewith and extending to a stabilizer yoke having an upper tread engagement surface;

wherein the first platform projects to one side of the stabilizer;

a second platform pivotally connected to the stabilizer and the first platform at their juncture and projecting to an opposite side of the stabilizer and having a second user support surface mounted for selective adjustment in relation to the first platform between an operative position wherein the second user support surface is substantially coplanar with the first user support surface, and an inoperative position wherein the second user support surface is positioned angularly toward the stabilizer.

2. A split platform ladder stand as defined by claim 1 wherein the stabilizer yoke is adjustable toward and away from the lower tread engagement surface.

3. A split platform ladder stand as defined by claim 1 wherein the stabilizer yoke is positioned between the first and second platforms.

4. A split platform ladder stand as defined by claim 1 wherein the stabilizer yoke includes a notch configured to receive and secure the stabilizer to ladder treads of various configurations.

5. A split platform ladder stand as defined by claim 1 wherein the stabilizer yoke includes a notch configured to receive and secure the stabilizer to ladder treads of various configurations and wherein the stabilizer yoke is adjustable toward and away from the lower tread engagement surface.

6. A split platform ladder stand as defined by claim 1 wherein:

the stabilizer yoke includes a notch configured to receive and secure the stabilizer to ladder treads of various configurations;

the stabilizer yoke is adjustable toward and away from the lower tread engagement surface; and the stabilizer yoke is angularly adjustable to permit selective angular adjustment of the user support surfaces about a ladder tread.

7. A split platform ladder stand as defined by claim 1 wherein:

the stabilizer yoke is angularly adjustable to permit selective angular adjustment of the user support surfaces about a ladder tread.

8. A split platform ladder stand as defined by claim 1 wherein the first platform includes an inside edge positioned adjacent the second platform and wherein the stabilizer is secured to the first platform adjacent the inside edge.

9. A split platform ladder stand as defined by claim 1 wherein the first platform includes lower tread engaging cleats configured to receive and stabilize the first platform on a ladder tread.

10. A split platform ladder stand as defined by claim 1 wherein the first platform includes lower tread engaging cleats configured to receive and stabilize the first platform on a ladder tread; and wherein the lower tread engaging cleats are adjustable toward and away from one another to accommodate ladder treads of differing configurations.

11. A split platform ladder stand as defined by claim 1 further comprising:

a tread latch mechanism on the first platform and movable from an inoperative tread release position to an operative position configured to elevationally secure the first platform to a ladder tread.

12. A split platform ladder stand for releasable attachment between adjacent lower and upper treads on a conventional ladder, comprising a first platform;

a first user support surface on the first platform;

a stabilizer fixedly mounted to the first platform and extending upwardly therefrom and forming an L-shape therewith and extending to a stabilizer yoke configured to engage an upper ladder tread on a ladder;

a bottom stabilizer on the first platform and configured to engage a lower ladder tread downwardly adjacent the upper ladder tread on the ladder wherein the first platform projects to one side of the stabilizer;

a second platform pivotally connected to the stabilizer and the first platform at their juncture about a pivot axis and projecting to an opposite side of the stabilizer;

a second user support surface on the second platform; and wherein the second platform is pivotable on the pivot axis relative to the first platform and stabilizer between:

(a) an inoperative mounting and dismounting position wherein the second user support surface is oriented at an angle that is in a range of obtuse to approximate perpendicularity to the first user support surface, to permit mounting and dismounting of the ladder stand to and from a ladder and to permit foot access to the lower and upper ladder treads; and (b) an operative position in which the first and second user support surfaces are substantially coplanar and positioned to rest against the lower ladder tread and support a user.

13. A split platform ladder stand as defined by claim 12 wherein the stabilizer yoke is adjustable toward and away from the lower tread engagement surface.

14. A split platform ladder stand as defined by claim 12 wherein the stabilizer yoke is positioned between the first and second platforms.

15. A split platform ladder stand as defined by claim 12 wherein the stabilizer yoke includes a notch configured to receive and secure the stabilizer to ladder treads of various configurations.

16. A split platform ladder stand as defined by claim 12 wherein the stabilizer yoke includes a notch configured to receive and secure the stabilizer to ladder treads of various configurations and wherein the stabilizer yoke is adjustable toward and away from the lower tread engagement surface.

17. A split platform ladder stand as defined by claim 12 wherein:

the stabilizer yoke includes a notch configured to receive and secure the stabilizer to ladder treads of various configurations;

the stabilizer yoke is adjustable toward and away from the lower tread engagement surface; and the stabilizer yoke is angularly adjustable to permit selective angular adjustment of the user support surfaces about a ladder tread.

18. A split platform ladder stand as defined by claim 12 wherein:

the stabilizer yoke is angularly adjustable to permit selective angular adjustment of the user support surfaces about a ladder tread.

19. A split platform ladder stand as defined by claim 12 wherein the first platform includes an inside edge positioned adjacent the second platform and wherein the stabilizer is secured to the first platform adjacent the inside edge.

20. A split platform ladder stand as defined by claim 12 wherein the bottom stabilizer includes lower tread engaging cleats configured to receive and stabilize the first platform on a ladder tread.

21. A split platform ladder stand as defined by claim 12 wherein the bottom stabilizer includes lower tread engaging cleats configured to receive and stabilize the first platform on a ladder tread; and wherein the lower tread engaging cleats are adjustable toward and away from one another to accommodate ladder treads of differing configurations.

22. A split platform ladder stand as defined by claim 12 further comprising:

a tread latch mechanism on the first platform and movable from an inoperative tread release position to an operative position configured to elevationally secure the first platform to a ladder tread.

23. A split platform ladder stand for releasable attachment between selected adjacent upper and lower treads on a ladder, comprising a first platform including a first user support surface and a lower tread engagement surface;

a stabilizer fixedly mounted to the first platform and extending upwardly therefrom and forming an L-shape therewith and extending to a stabilizer yoke having an upper tread engagement surface wherein the first platform projects to one side of the stabilizer;

a second platform pivotally connected to the stabilizer and the first platform at their juncture about a pivot axis and projecting to an opposite side of the stabilizer and having a second user support surface mounted for selective adjustment on the pivot axis in relation to the first platform between an operative position wherein the second user support surface is substantially coplanar with the first user support surface, and an inoperative position to provide foot access to an adjacent ladder tread.

* * * * *

UNITED STATES PATENT AND TRADEMARK OFFICE

CERTIFICATE OF CORRECTION

PATENT NO : 6,109,392

DATED : August 29, 2000

INVENTOR(S) : Harry G. Merrick

It is certified that error appears in the above-identified patent and that said Letters Patent are hereby corrected as shown below:

Col. 5, line 21
replace "adder"
with --ladder--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*